US005431133A

United States Patent [19]

Spath et al.

[11] Patent Number: 5,431,133

[45] Date of Patent: Jul. 11, 1995

[54] LOW MASS TWO-STEP VALVE LIFTER

[75] Inventors: Mark J. Spath, Spencerport; Christopher M. De Minco, Honeoye Falls; Scott H. Nather, Churchville, all of N.Y.

[73] Assignee: General Motors Corporation, Detroit, Mich.

[21] Appl. No.: 251,702

[22] Filed: May 31, 1994

[51] Int. Cl.[6] ..... F01L 1/34; F01L 1/16

[52] U.S. Cl. ..... 123/90.16; 123/90.5; 123/90.55; 74/569

[58] Field of Search ..... 123/90.15, 90.16, 90.17, 123/90.27, 90.48, 90.49, 90.5, 90.52, 90.55; 74/569

[56] References Cited

U.S. PATENT DOCUMENTS

| | | | |
|---|---|---|---|
| 3,277,874 | 10/1966 | Wagner | 123/90 |
| 5,090,364 | 2/1992 | McCarroll et al. | 123/90.16 |
| 5,186,130 | 2/1993 | Melchior | 123/90.35 |
| 5,193,496 | 3/1993 | Krüger | 123/90.16 |
| 5,253,621 | 10/1993 | Dopson et al. | 123/90.16 |
| 5,287,830 | 2/1994 | Dopson et al. | 123/90.16 |
| 5,297,516 | 3/1994 | Hara | 123/90.16 |
| 5,343,833 | 9/1994 | Shirai | 123/90.16 |
| 5,345,904 | 9/1994 | Dopson et al. | 123/90.16 |
| 5,351,662 | 10/1994 | Dopson et al. | 123/90.16 |
| 5,361,733 | 11/1994 | Spath et al. | 123/90.16 |

FOREIGN PATENT DOCUMENTS

| | | |
|---|---|---|
| 3347680 | 8/1984 | Germany . |
| 3543537 | 4/1986 | Germany . |
| 0468201 | 6/1991 | Germany . |
| 0468202 | 6/1991 | Germany . |
| WO93/05277 | 3/1993 | Germany . |
| 4213855 | 10/1993 | Germany . |
| 4334505 | 4/1994 | Germany . |
| 4334517 | 4/1994 | Germany . |

*Primary Examiner*—Henry O. Yuen
*Assistant Examiner*—Weilun Lo
*Attorney, Agent, or Firm*—Karl F. Barr, Jr.

[57] ABSTRACT

A low mass two-step valve lifter has concentric inner and outer cylindrical cam followers engagable by radially disposed axially aligned lock pins in the outer high lift follower. Both inner and outer followers have cylindrically crowned cam engaging surfaces for high lift capability and low load eccentricity. The lock pins are positioned on the lifter thrust axis normal to the direction of the engine camshaft axis and the skirt has upward seal extensions and downward extending skirt portions adjacent the lock pin openings to maintain seal area. Other skirt portions are cut away to reduce weight. Vent holes in the lock pins discharge collected oil that might interfere with fast pin engagement. A separate passage is provided to feed oil to a hydraulic lash adjuster disposed in the inner follower cylinder. A single guide pin aligns the dual followers with the external bore oil ports and the camshaft cams. Additional features are also disclosed.

18 Claims, 3 Drawing Sheets

44
140
132
90
92
84
86
88
3
4
5,6
114
130
128
126
124
32
34
30
26
28
42
36
24
38
40
2
20
22
16
18
12
14
10

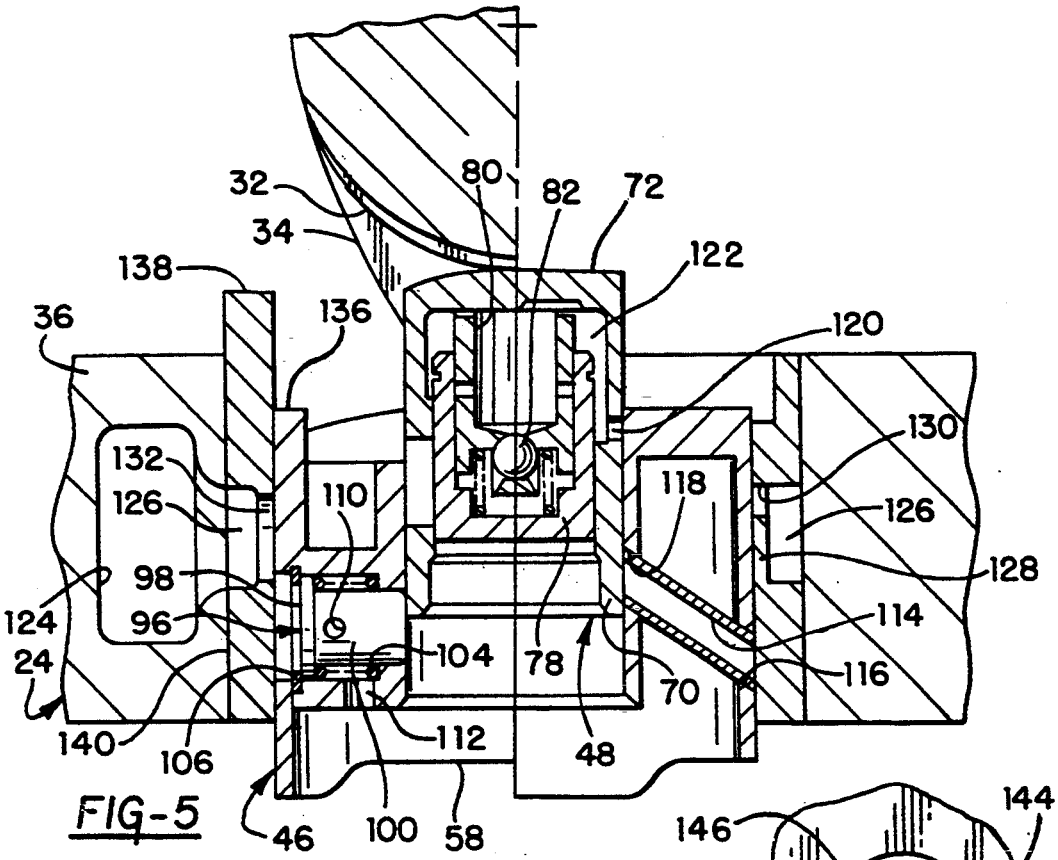
FIG-5
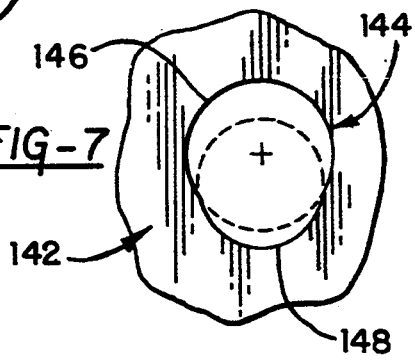
FIG-7
FIG-6
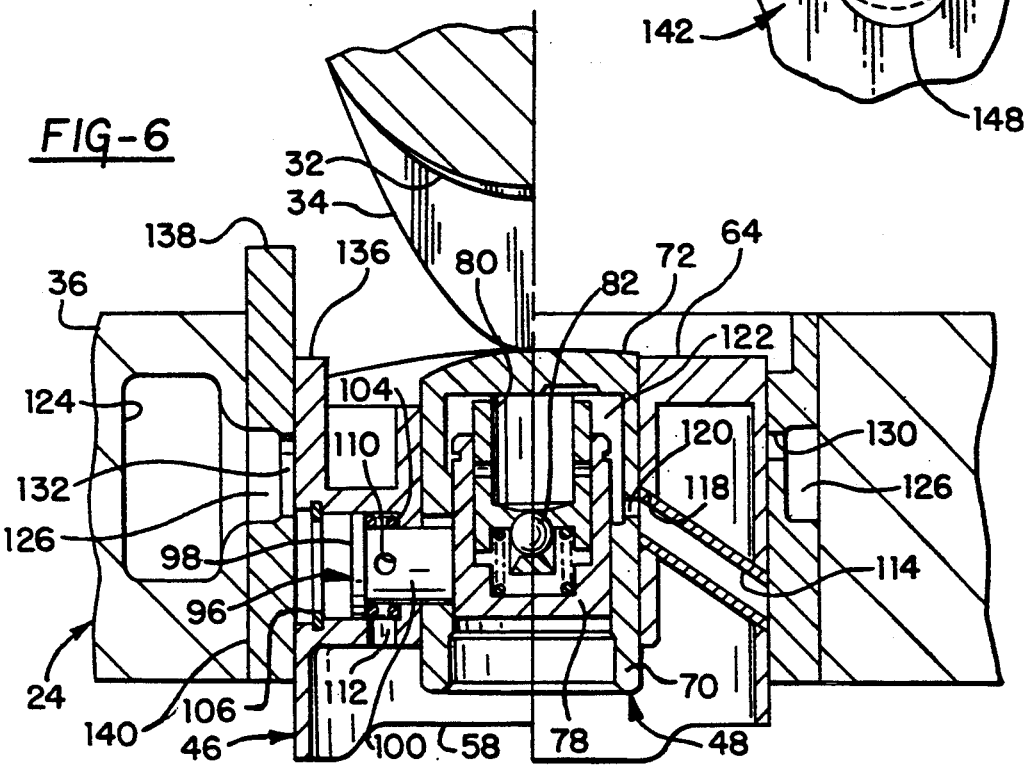

LOW MASS TWO-STEP VALVE LIFTER

TECHNICAL FIELD

This invention relates to valve lifters for internal combustion engines and the like. In particular, the invention relates to direct acting two-step valve lifters such as may be used in overhead cam engines.

BACKGROUND

United States patent application Ser. No. 08/011,667, filed Jan. 28, 1993, now U.S. Pat. No. 5,361,733, and assigned to the assignee of the present invention, discloses various embodiments of compact valve lifters for internal combustion engines, including some variable valve actuating types, called two-step lifters. These provide two alternative lift curves for actuating a single valve of an engine cylinder to provide variable valve lift and/or timing. Preferably, the lifters have two concentric cylindrical followers actuated by adjacent cams of an associated camshaft and include locking means for connecting the followers together when operating in the extended or high valve lift mode.

United States patent application Ser. No. 08/212,466, filed Mar. 14, 1994 and assigned to the assignee of the present invention, discloses a low mass direct acting valve lifter which includes as a feature a small sized hydraulic element assembly (HEA), or lash adjuster, referred to as a micro HEA. Use of this small HEA in the lifter provides a substantial reduction in the reciprocating mass of the lifter, which can raise valve train speed capability while reducing operating power requirements.

SUMMARY OF THE INVENTION

The present invention combines some of the features of these earlier disclosures with additional concepts to provide compact low mass two-step direct acting lifters particularly suited for use in high speed overhead cam engines. Among the features provided or available in lifters according to the invention are:

1. Both inner and outer followers have cylindrically crowned cam engaging surfaces to provide high lift capability with reduced eccentric loading.
2. The locking mechanism preferably includes cylindrical locking pins in the outer lifter which mate with complementary openings in the inner lifter. The openings may be cylindrical (single bored) with adequate clearance to insure positive engagement. Optionally, double bored overlapping cylindrical openings can provide an enlarged clearance opening for sure engagement combined with a smaller diameter seating opening offset toward the loaded side to accept the lock pin loading during valve actuation. This provides loaded surfaces of the openings which conform more closely with the pin diameters and thereby reduce the engagement stresses in the pins and the inner lifter.
3. The lock pins are positioned on the thrust axis which lies normal to the direction of the associated camshaft axis so that the pin bores open through the lifter outer surface in alignment with the low lift cam which engages the inner lifter. Seal lands extend up from the lifter outer follower skirt and the adjacent engine lifter bore above the pin bores beyond the height of the adjacent high lift cam engaging surfaces. This provides added sealing area around the pin bores and the communicating oil feed passages to limit leakage of pressure oil around the pin openings.
4. The outer follower skirt is partially cut away between the thrust sides to reduce weight. The length along the thrust sides is maintained to maintain the desired oil sealing area.
5. Intersecting axial and transverse vent holes in the lock pins disperse collected oil to assure fast pin response and positive engagement.
6. A single guide pin in the outer cam follower engages alignment grooves in both the lifter bore and the inner follower to maintain both followers in alignment with their respective cams. A semi-cylindrical head may be provided on the pin for engagement with a mating groove in the lifter bore.
7. The lifter includes independent oil supply ports for lock pin and hydraulic lash adjuster (HEA) operation. If separately controlled pressure sources are provided, this will allow the HEA to operate at a pressure independent of the lock pin pressure, which can provide improved lifter operation with a system operating at a lower overall oil pressure.

These and other features and advantages of the invention will be more fully understood from the following description of certain specific embodiments of the invention taken together with the accompanying drawings.

BRIEF DRAWING DESCRIPTION

In the drawings:

FIG. 5 is a combined axial cross-sectional view along the line 5—5 of FIG. 2 but showing the lifter at the high point of the low lift mode;

FIG. 6 is a view similar to FIG. 5 along the line 6—6 of FIG. 2 but showing the lifter at the high point of the high lift mode;

FIG. 7 is a side view of an optional inner follower cylinder showing a "double bored" lock opening embodiment.

DETAILED DESCRIPTION

Figures 1, 2:
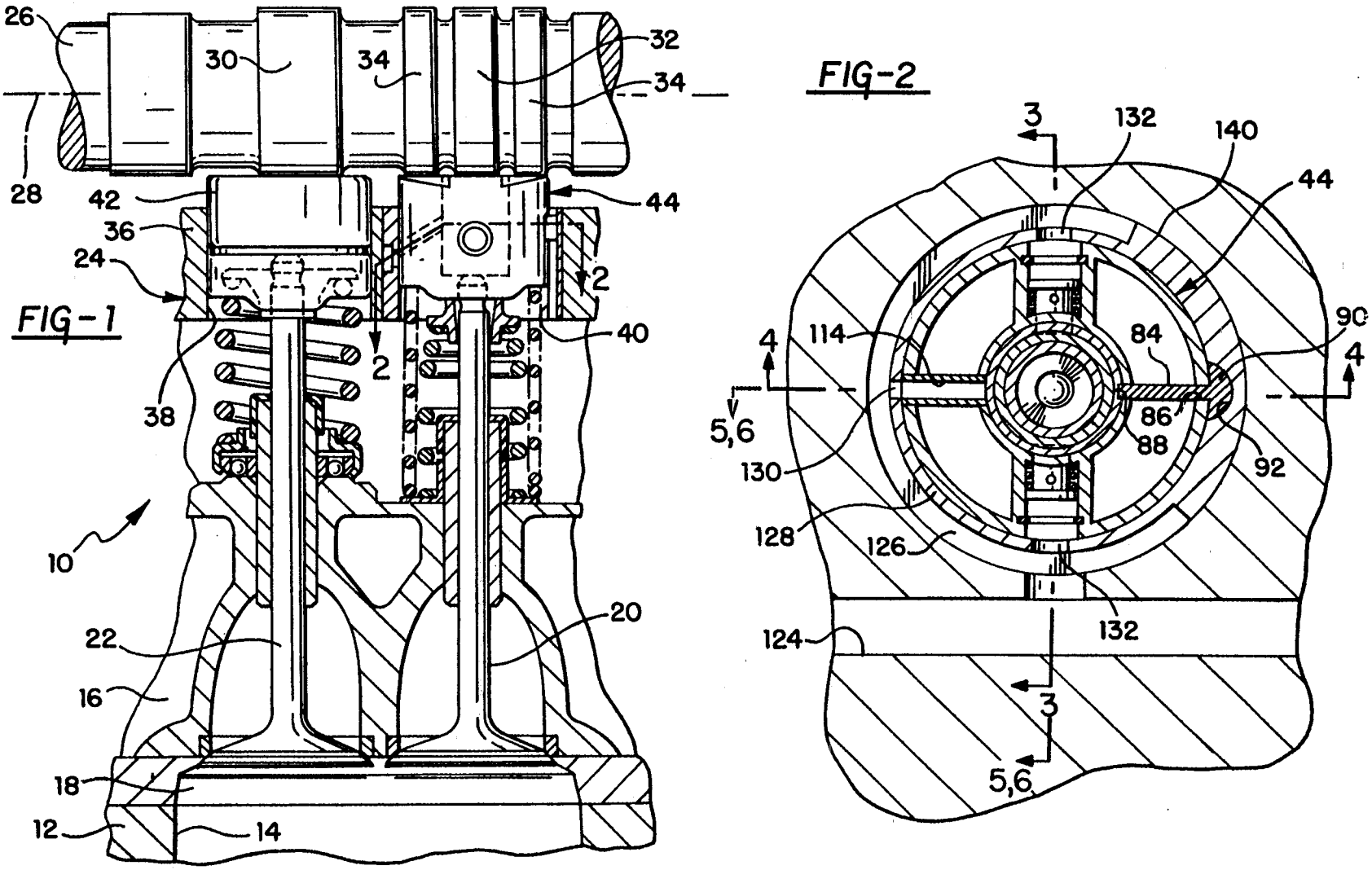
FIG. 1 is a longitudinal cross-sectional view through a portion of an engine showing direct acting valve mechanism including a two-step lifter according to the invention.
FIG. 2 is a an enlarged transverse cross-sectional view along the line 2—2 of FIG. 1 showing the oil supply passages,locking pins and guide pin in the lifter of FIG. 1.

Referring now to the drawings in detail, numeral 10 generally indicates an overhead cam internal combustion engine having a cylinder block 12 including a number of cylinders 14, one of which is shown. The block 12 supports a cylinder head 16 closing the ends of the cylinders and defining a combustion chamber recess 18 for each cylinder. The head 16 carries inlet valves 20, 22 and exhaust valves, not shown, at least one of each for each cylinder. These valves respectively control the admission of air and fuel to the cylinders and the discharge of exhaust products from the cylinders.

A camshaft carrier 24 is supported on the cylinder head and carries a camshaft 26 for rotation on a longitudinal axis 28. The camshaft includes a single cam 30 for each inlet valve 22 that is operable with a single lift profile. However, for each inlet valves 20, which is operable with a two-step high-low lift profile, the camshaft 26 is provided with three axially spaced cams, a central low lift cam 32 and a pair of high lift cams 34 spaced on opposite sides of the low lift cam 32. If desired the remaining inlet valves 22 and/or some or all of the exhaust valves may also be provided with two-step or multi-step lifters within the scope of the invention.

A lifter gallery 36, in this case forming part of the camshaft carrier 24, has a plurality of lifter bores 38, 40 respectively aligned with the single lift profile valves and the two-step lift profile valves. A conventional single follower direct acting hydraulic valve lifter (DAHVL) 42 is reciprocable in each of the lifter bores 38 and engages the associated valve 22 and cam 30 so as to actuate the valve 22 in known conventional manner.

In accordance with this invention, a low mass two-step valve lifter 44 is reciprocable in each of the lifter bores 40 and engages the associated valve 20 and cams 32, 34 for actuating the valves 20 in a manner to be subsequently described. The particular embodiment of lifter 44 that will now be described is denominated CVDAH for "crowned variable direct acting hydraulic" two-step valve lifter. However, many of the described features are clearly applicable to various other embodiments that may be formed in accordance with the invention.

Each CVDAH lifter 44 includes an outer high lift cam follower 46 and an inner low lift cam follower 48. The outer follower 46 includes an annular cylindrical body 50 having a cam engaging outer end 52 connecting with a skirt 54 having a cylindrical outer surface 56 and extending to an open inner end 58 of the body. Inwardly, an inner wall 60 extends from the outer end having a cylindrical inner surface 62 concentric with the outer surface 56. The outer end 52 includes a pair of cam engaging surfaces 64 spaced laterally of the lifter in the longitudinal direction of the camshaft axis and generally on either side of the intersecting cylindrical inner surface 62. Surfaces 64 are cylindrically crowned, forming an arc of a cylinder centered on an axis, not shown, parallel with the camshaft axis 28 as installed. This allows for a relatively long valve lift motion while limiting the eccentricity of cam contact with the surfaces 64 to within a reasonable lifter diameter.

The inner follower 48 comprises a hollow cylinder 66 having a closed end 68 and a depending cylindrical outer wall 70. The closed end has a cam engaging outer surface 72 which is cylindrically crowned, forming an arc of a cylinder centered on an axis, not shown, parallel with the camshaft axis 28, as installed. The outer wall 70, is received in the cylindrical inner surface 62 of the outer follower 46 for reciprocation on a common axis 74. Within the follower cylinder 66 there is reciprocably received a small sized hydraulic lash adjuster or hydraulic element assembly, sometimes referred to as a micro HEA or HEA 76. This HEA includes a hollow piston 78 internally carrying a plunger 80 with a check valve 82 and other elements similar to conventional HEA's, although of smaller size.

To maintain the orientation of the inner and outer followers with their respective cams, a guide pin 84 extends through a radial opening 86 in the outer follower 46. An inner end of the pin engages a groove 88 provided in the outer wall 70 of the cylinder 66. A part cylindrical head 90 extends outward of the follower 46 into a semi-cylindrical groove 92 extending axially in the associated lifter bore 40 of the lifter gallery.

At right angles to the direction of the camshaft axis 28 and the parallel axes of the crowned surfaces 64, 72, the outer follower 46 is provided with lock pin openings 94. These are stepped to receive lock pins 96 having enlarged heads 98 and slightly smaller cylindrical bodies 100. The inner ends of the pins 96 are receivable in lock openings 102 provided in the cylinder 66 of the inner cam follower 48. Concentric compression springs 104 under the heads 98 bias the pins outwardly toward disengagement with lock openings 102 and against the lock rings 106 retained in the openings 94. The pins also include vent openings 108 extending axially from the inner ends of the pins to cross-drilled passages 110. These connect with annular spaces in which the springs 104 are located, and from thence to drain holes 112 from the pin openings inwardly of the inner positions of the heads 98.

Parallel with and opposite to the location of the guide pin 84, is an oil feed passage 114. The passage extends from an opening 116 in the lifter skirt up through a surrounding tube to a second opening 118 in the inner wall of the outer follower. There the passage connects with a port 120 through the cylinder outer wall 70 which, in turn, connects through a scalloped extension with an annular recess 122, within the cylinder, that feeds oil into the lash adjuster in a manner essentially the same as in conventional direct-acting hydraulic lash adjusters.

In order to supply oil to the lock pins and the lash adjuster, the lifter gallery 36 is provided with an oil passage or gallery 124 extending parallel with the camshaft access. At each lifter location, the gallery 124 is connected with a semi-circumferential transfer port 126. The transfer port extends around three sides of the lifter bore, excluding that portion in which the groove 92 for the guide pin head is located. However, the port 126 is separated from the lifter bore by a wall 128, through which distribution ports are provided, including a small HEA feed port 130 and a pair of larger pin supply ports 132, aligned with the lock pins 96.

In order to maintain minimum mass for the lifter, the length of the skirt 54 of the outer follower is shortened in the direction of the camshaft axis, as at 134 where the skirt is generally aligned with the oil feed passage 114 and the guide pin 84. However, the size of the openings 94 for the lock pins 96 is sufficiently great as to require an extended skirt length at right angles to the direction of the camshaft axis 28 in order to provide sufficient sealing area to prevent leakage of high-pressure oil throughout the travel range of the outer follower. In similar fashion, the skirt of the lifter is extended upwardly at its edges between the cam engaging surfaces 64 of the outer lifter, to provide upwardly extending seal lands 136. Corresponding upward extensions 138 of the lifter bores 40 are provided having a circumferential length equivalent to that of the seal lands.

In the illustrated embodiment, the lifter bore 40 is defined by a separate sleeve 140 into which is machined the transfer port 126, and which also includes the extensions 138 as well as the ports 130 and 132. However, it should be understood that these features could, if desired, be cast or otherwise provided within a lifter gallery, cylinder head or other lifter-receiving component of an engine without the use of a separate sleeve.

Figure 3:
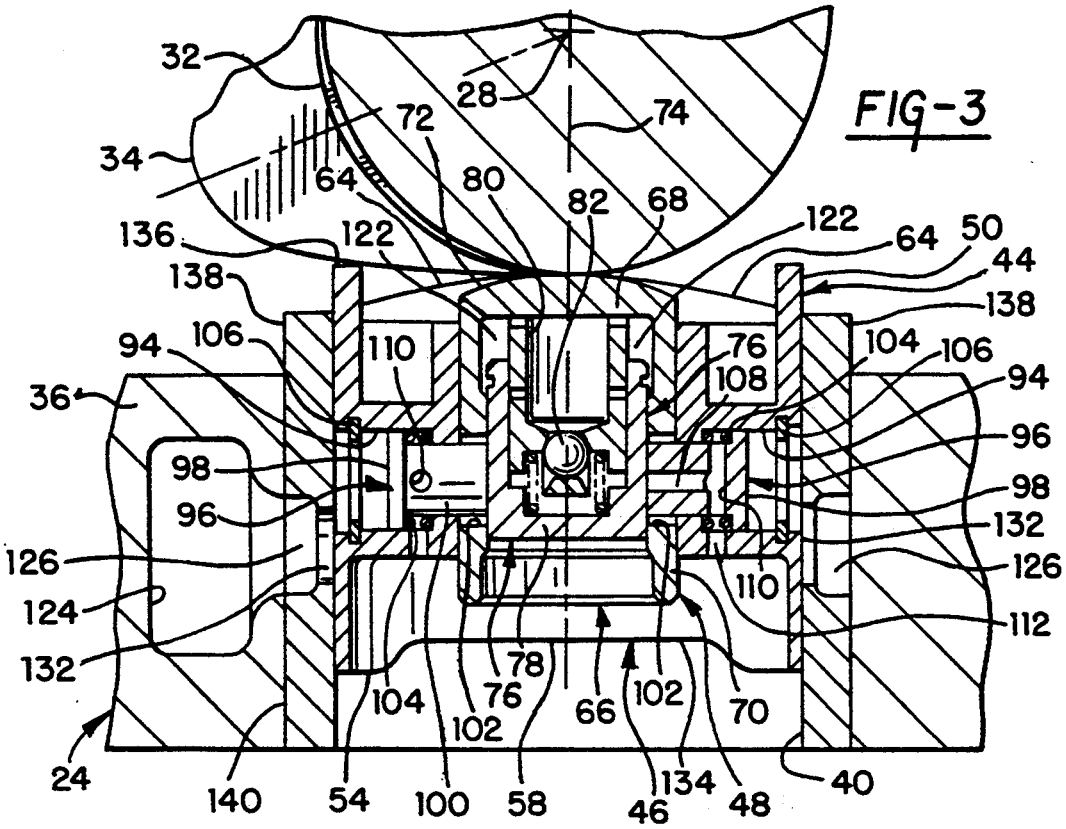
FIG. 3 is an axial cross-sectional view normal to the camshaft axis and along the line 3—3 of FIG. 2 showing the interior of the lifter with the locking pins engaged and the lifter in the base circle position.
Figure 4:
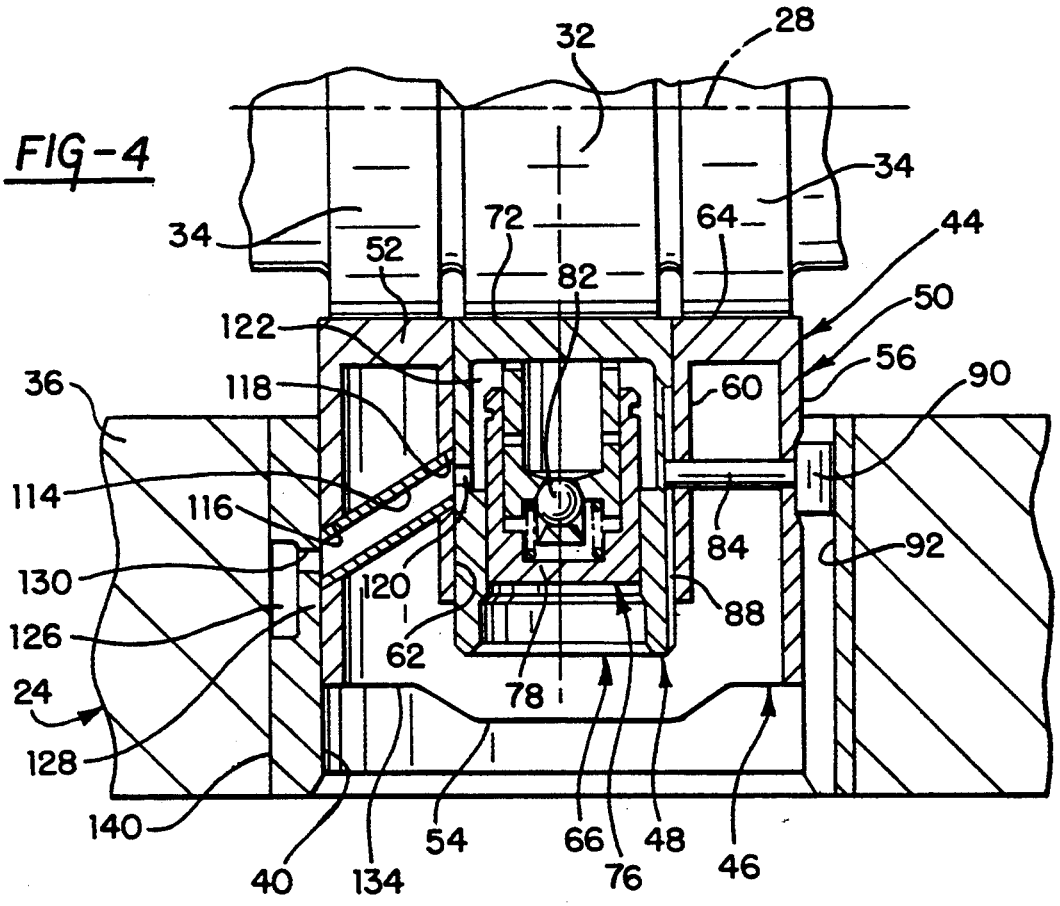
FIG. 4 is an axial cross-sectional view parallel with the camshaft axis and along the line 4—4 of FIG. 2 showing the lash adjuster oil feed and the guide pin arrangement.

In operation, the two-step lifter 44 receives pressurized lubricating oil from the oil gallery 124 through the transfer port 126. With the lifter in the base circle position, as shown in FIGS. 1–4, oil is transferred through the passage 114 by openings 116–118, into the hollow cylinder 66 of the inner low lift follower 48 in order to feed the lash adjuster or micro HEA 76, and allow it to take up the valve lash in a conventional manner.

Contemporaneously, pressure oil is fed through the pin supply ports 132 to act against the heads 98 of the lock pins 96. This pressure is modulated as desired by a valve or other apparatus so that, at the low-pressure setting, the lock pin springs 104 maintain the pins in an outward disengaged position against the oil pressure which is, however, great enough to maintain adequate oil supply to the HEA. When the oil pressure is raised to a second higher level, it overcomes the force of the springs 104 and forces the lock pins 96 inwardly into the openings 94 of the inner follower cylinder 50, thus locking together the inner and outer followers. The axial vent openings 108 and cross drilled or transverse passages 110 in the lock pins 96 vent any oil which may be collected in the lock openings 102. The vented oil, together with that in the space around the lock pins, is forced out through the drain openings 112 so that quick and positive engagement of the lock pins 96 is permitted.

When the followers are locked together, the inner follower 48 is carried along with the outer follower 46 through its full stroke, except for the lash between the lock pins and lock openings as shown in FIG. 6, so that the engine valve is actuated to the maximum desired opening. When the oil pressure is again reduced and the lock pins 96 are again disengaged, the inner follower is driven only to the maximum opening of the low lift cam 32 as shown in FIG. 5, so that the valve is opened only a small amount as shown in the drawing. The amount of opening or lift of the low lift cam is of course capable of being established at any desired level less than that of the high-lift cam to suit the particular purposes intended.

Optionally, various alternative features may be provided in two-step valve lifters according to the invention. FIG. 7 shows, for example, a modified hollow cylinder 142 having "double bored" lock openings 144. These lock openings 144 include a clearance bore 146 similar to the lock openings 102 of the prior embodiment. In addition, a second smaller bore 148, having a diameter near that of the pin bodies 100, is provided overlapping the lower edge of the clearance bore 146. In operation in the high lift mode, the lock pins 96 are engaged by entry into the larger clearance bores 146. Then, when the outer follower 46 is actuated downward, the pins engage the smaller diameter edges of the bores 148 which closely conform to the pin bodies 100. As the inner follower 48 is then driven downward by the lock pins 96, the valve opening forces are thus distributed over a greater area of the cylinder 142 and pin bodies 100, reducing stresses in the assembly.

Alternative oiling systems could also be provided. For example, the lash adjuster in the inner low lift follower could be supplied with oil through passages, not shown, extending from the lock pin openings in the outer follower at least partially through its interior to the feed port 120 in the inner follower. While simplifying the external oil feed system, this arrangement would add mass to the reciprocating outer high lift follower, which may not be desirable.

The lifter feed arrangement shown, having separate external feed ports 130, 132 for the lash adjuster oil supply and the lock pin pressure oil, respectively, has a further advantageous variation. Separate external oil supply passages, not shown, could be provided for oil delivery to the lash adjuster in the inner follower and to the two lock pins. In this way, high and low pressure modulation required for actuating the lock pins can be separated from the pressure supplied to the lash adjuster. The lash adjuster supply can be maintained at a relatively high pressure as in conventional lifters to improve hydraulic operation of the lash adjuster. Also, the lock pin oil pressure can be further reduced or cut off completely when the lock pins are disengaged, simplifying the control system and improving pin response time due to a larger relative pressure change between pin engaged and disengaged operating modes.

As another option, a two-step lifter as described could be modified by substituting a mechanical lash cap for the hydraulic lash adjuster (HEA) of the described embodiment. The oil feed ports and passages to the lash adjuster could, of course, be deleted in this case.

While the invention has been described by reference to certain specific embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. A two-step valve lifter comprising:

a high lift cam follower including a cylindrical body with first and second annular ends and concentric inner and outer cylinder surfaces centered on a reciprocation axis, the first annular end including a pair of fixed cylindrically crowned cam engaging surfaces laterally spaced on opposite sides of the axis, the cam engaging surfaces curving about and lying parallel with a lateral axis extending normal to the reciprocation axis;

a low lift cam follower reciprocably carried within the high lift follower and including a hollow cylinder with at least one substantially closed end, a second end and a cylindrical outer wall reciprocably engaging the inner cylinder surface of said body, the closed end including a third fixed cylindrically crowned cam engaging surface located generally between said pair of cam engaging surfaces and curving about and lying parallel with a second lateral axis extending normal to the reciprocation axis and parallel with said first named lateral axis, and a contact device carried in the hollow cylinder for engaging a valve element of an associated valve train; and lock pins selectively operable to act between the high and low lift cam followers to lock the followers together for coincident reciprocating motion.

2. The invention as in claim 1 and further including a guide associated with the body and cooperable with the cylinder and with external alignment means to maintain angular alignment of the body relative to the cylinder and such external means.

3. The invention as in claim 2 wherein said guide comprises a guide pin received in a radial opening of said body, the guide pin including an inner end extending into a groove in the outer wall of the cylinder to maintain alignment of the two followers and the guide pin including a head extending outward of the outer cylinder surface for engagement with such external means to maintain alignment therewith.

4. The invention as in claim 3 wherein said head of the guide pin is of part cylindrical configuration for cooperation with a part cylindrical groove in said external means.

5. The invention as in claim 1 wherein said lock pins comprise a pair of hydraulically actuated members disposed in radial lock pin openings of the body aligned on an axis normal to the plane of said lateral axes.

6. The invention as in claim 5 and further including seal lands on the body and extending said outer cylindrical surface intermediate said pair of cam engaging surfaces and above the level thereof to provide added seal length over the lock pin openings.

7. The invention as in claim 6 wherein said outer cylindrical surface is defined in part by a depending skirt, said skirt having a lower edge with portions angularly intermediate the lock pin openings shortened to reduce weight and portions angularly adjacent the lock pin openings being maintained full length to provide adequate seal area around the lock pins.

8. The invention as in claim 5 wherein said lock pins have inner ends engagable with lock openings in said low lift follower, said lock pins further comprising axial vent passages extending from said inner ends and communicating with drain openings in said body for discharging accumulated fluid from the lock openings and promoting fast engagement of the lock pins.

9. The invention as in claim 8 wherein said axial vent passages connect with cross drilled passages in the lock pins to vent fluid to annular spaces around the lock pins and in communication with the drain openings.

10. The invention as in claim 1 wherein the contact device comprises a hydraulic lash adjuster.

11. The invention as in claim 5 wherein said lock openings comprise single bore clearance openings extending radially through said cylinder.

12. The invention as in claim 5 wherein said lock openings comprise double bore openings through the cylinder, each including a clearance opening and an overlapping smaller opening.

13. The invention as in claim 5 wherein said lock pins include axial vent passages extending from said inner ends and communicating with drain openings in said body for discharging accumulated fluid from the lock openings and promoting fast engagement of the lock pins.

14. The invention as in claim 5 wherein said lock pins are biased outward toward disengagement from the lock openings by concentric compression springs engaging enlarged heads on outer ends of the lock pins.

15. The invention as in claim 5 wherein said contact device in the hollow cylinder comprises a hydraulic lash adjuster, the invention further comprising:

first oil supply means extending from a passage opening in the outer cylinder surface of said body through said high lift cam follower and through the outer wall of said cylinder to supply pressure oil to said hydraulic lash adjuster;

said lock pin openings also extending through the outer cylinder surface of said body to supply pressure oil to said lock pins, said passage opening being spaced apart from said lock pin openings at said outer cylinder surface and said first oil supply means being internally separate from said lock pin openings so that pressure oil may optionally be supplied from common or distinct sources at the same or different pressures to said oil supply means and said lock pin openings.

16. In combination in an internal combustion engine, a camshaft rotatable on an axis and having a group of axially spaced cams including a low lift cam and a pair of high lift cams spaced on opposite sides of the low lift cam, a lifter gallery adjacent the camshaft and including a lifter bore opening toward said cams, an engine valve axially aligned with the lifter bore, and a two-step valve lifter engaging the cams and the valve for selectively transmitting to the valve the lift curves of the various cams, the valve lifter comprising:

a high lift cam follower including a cylindrical body with first and second annular ends and concentric inner and outer cylinder surfaces centered on a reciprocation axis, the first annular end including a pair of fixed cylindrically crowned cam engaging surfaces engaging the high lift cams and laterally spaced on opposite sides of the axis, the cam engaging surfaces curving about and lying parallel with a lateral axis extending normal to the reciprocation axis;

a low lift cam follower reciprocably carried within the high lift follower and including a hollow cylinder with at least one substantially closed end, a second end and a cylindrical outer wall reciprocably engaging the inner cylinder surface of said body, the closed end including a third fixed cylindrically crowned cam engaging surface engaging the low lift cam and located generally between said pair of cam engaging surfaces, the third cam engaging surface curving about and lying parallel with a second lateral axis extending normal to the reciprocation axis and parallel with said first named lateral axis, and a contact device carried in the hollow cylinder and engaging the valve; and lock pins selectively operable to act between the high and low lift cam followers to lock the followers together for coincident reciprocating motion, said lock pins comprising a pair of hydraulically actuated members disposed in radial lock pin openings of the body aligned on an axis normal to the plane of said camshaft and valve axes;

the lifter gallery including raised portions of the lifter bore laterally aligned with the lock pin axis and located axially between the high lift cams to extend the sealing surface of the lifter bore adjacent the locations of the lock pin openings.

17. The invention as in claim 16 and further including seal lands on the high lift follower and defining portions of the outer cylindrical surface between and extending above the cam engaging surfaces to provide added sealing surface adjacent the lock pin openings.

18. The invention as in claim 16 wherein said contact device comprises a hydraulic lash adjuster, the invention and further including:

first oil supply means extending from a passage opening in the outer cylinder surface of said body through said high lift cam follower and through the outer wall of said cylinder to supply pressure oil to said hydraulic lash adjuster, said lock pin openings also extending through the outer cylinder surface of said body to supply pressure oil to said lock pins, said passage opening being spaced apart from said lock pin openings at said cylinder outer surface and said first oil supply means being internally separate from said lock pin openings so that pressure oil may optionally be supplied from common or distinct sources at the same or different pressures to said oil supply means and said lock pin openings.

* * * * *